US006024524A

United States Patent [19]

Bräker et al.

[11] Patent Number: 6,024,524

[45] Date of Patent: Feb. 15, 2000

[54] METHOD OF MANUFACTURING BOOK BLOCKS FROM VARIOUS PRINTED SHEETS HAVING SEVERAL QUARTO SHEETS WHICH ARE INSERTED INTO ONE ANOTHER

[75] Inventors: Arnold Bräker, Winterthur; Wilfried Weibel, Wil, both of Switzerland

[73] Assignee: Grapha-Holding AG, Hergiswil, Switzerland

[21] Appl. No.: 09/115,805

[22] Filed: Jul. 15, 1998

[30] Foreign Application Priority Data

Jul. 22, 1997 [CH] Switzerland ..... 1775/97

[51] Int. Cl.[7] ..... B65H 5/30

[52] U.S. Cl. ..... 412/6; 412/1; 412/2; 412/4; 412/9; 412/22; 412/27; 412/29; 412/34; 271/12; 271/16; 271/20; 83/276; 83/278; 83/423; 83/154; 83/151

[58] Field of Search ..... 412/1, 2, 4, 6, 412/9, 22, 27, 29, 34; 271/12, 16, 20; 83/276, 278, 423, 154, 151

[56] References Cited

U.S. PATENT DOCUMENTS 3,692,300 9/1972 Mebus ..... 270/52.26

4,958,974 9/1990 Schenk ..... 412/34

FOREIGN PATENT DOCUMENTS 2843831 4/1980 Germany .

3126769 6/1982 Germany .

*Primary Examiner*—Willmon Fridie, Jr.

*Assistant Examiner*—Mark T. Henderson

*Attorney, Agent, or Firm*—Friedrich Kueffner

[57] ABSTRACT

A method and an apparatus for manufacturing book blocks from various printed sheets composed of a plurality of quarto sheets which are inserted into one another, wherein the printed sheets are successively pulled fold first along a conveying path from a stack of printed sheets by a gripping unit of a feeder and are subsequently gathered with their flat sides placed against each other into book blocks. The gripping unit which grasps the printed sheets approximately at the fold thereof produces a deformation or injury which extends at least partially through the quarto sheets, so that the respective quarto sheets are secured relative to each other and displacements relative to each other are prevented.

8 Claims, 4 Drawing Sheets

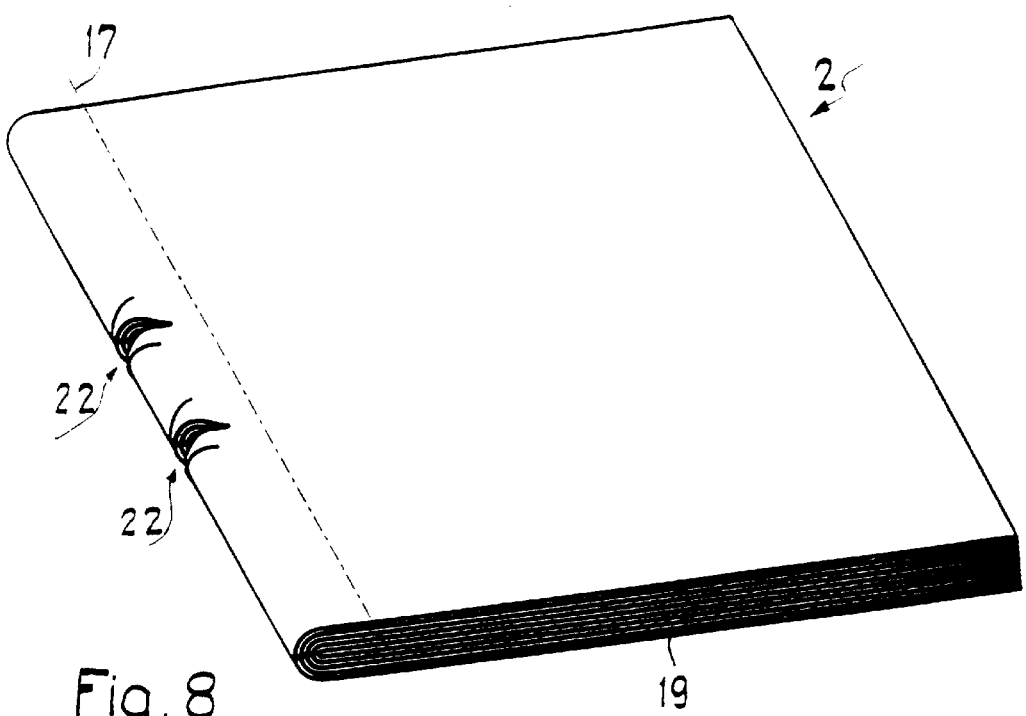
Fig. 8
Fig. 10
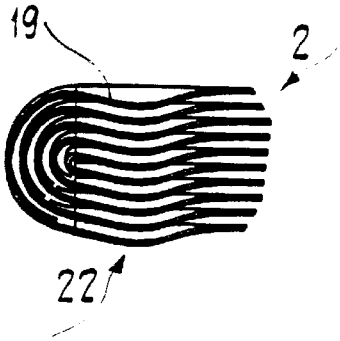
Fig. 9
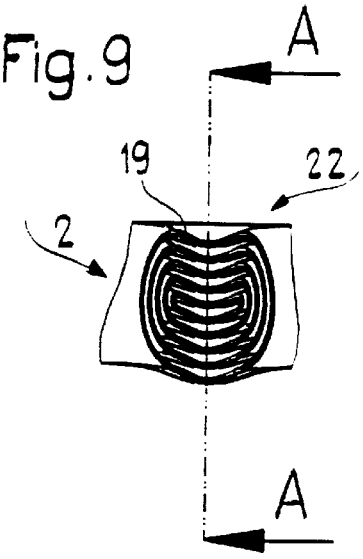

METHOD OF MANUFACTURING BOOK BLOCKS FROM VARIOUS PRINTED SHEETS HAVING SEVERAL QUARTO SHEETS WHICH ARE INSERTED INTO ONE ANOTHER

BACKGROUND OF THE INVENTION

1. Field of the Invention

The present invention relates to a method of manufacturing book blocks from various printed sheets composed of a plurality of quarto sheets which are inserted into one another, wherein the printed sheets are successively pulled fold first along a conveying path from a stack of printed sheets by gripping means of a feeder and are subsequently gathered with their flat sides placed against each other into book blocks.

2. Description of the Related Art

The above-described method is used for preparing, inter alia, book blocks in a gathering machine for gluing. A gathering machine is disclosed, for example, in DE-C-31 26 769. This gathering machine is composed of several feeding stations arranged along a conveying device which individually grasps the printed sheets stacked in a magazine on the side of the fold by means of revolving gripping drums and places the printed sheets in motion. The printed sheets which reach the conveying device approximately at a right angle to the conveying flow direction of the conveying device are transported from feeding station to feeding station by drive members which revolve on a pulling means, wherein additional printed sheets continue to be supplied and placed until the desired book block is formed.

The processing of printed sheets which are formed of quarto sheets inserted into one another, i.e., formed with three open side edges and also called tabloids, is frequently difficult because of the change of direction of the movement of the sheets at the transfer point of the drive members of the conveying device. The abrupt change of direction of the printed sheets from a direction of movement perpendicularly to the fold into a movement parallel to the fold may cause the individual quarto sheets to be shifted relative to each other, particularly when they are of lightweight paper, wherein these shifts can no longer be corrected during the continuing treatment process. Particularly the quarto sheets of a printed sheet placed on top has the tendency to be lifted off because it rests only loosely on the top and may also be moved by the ambient air in the conveying direction relative to the other printed sheets.

These irregularities lead to waste and render the process unreliable.

SUMMARY OF THE INVENTION

Therefore, it is the primary object of the present invention to provide a method of manufacturing book blocks of the above-described type in which the disadvantages described above are essentially eliminated.

In accordance with the present invention, the gripping means which grasp the printed sheets approximately at the fold thereof produce a deformation or injury which extends at least partially through the quarto sheets, so that the respective quarto sheets are secured relative to each other and displacements relative to each other are prevented.

In accordance with an advantageous feature, the deformation or injury is produced in the fold strip which is to be cut off later for binding the printed sheets, so that the traces of the injury are not transferred into the bound book block.

In accordance with a preferred feature, the injury of the printed sheets can be produced by a deformation tool, a punching tool or a perforating tool or another tool which produces a positively engaging connection between the quarto sheets.

In accordance with another advantageous feature, at least two quarto sheets forming a side of a printed sheet are deformed or injured, so that at least a unilateral connection is produced.

In accordance with a useful feature, the deformation or injury can be produced in the inclined fold portion of a printed sheet.

For carrying out the method according to the present invention for gathering printed sheets along a conveying path, it is suitable to use printed sheet feeders with controlled gripping means which are constructed by a tool which injures the printed sheet when being grasped at the fold area.

In the case of gripping means which have two tong components for forming controlled gripping tongs, preferably at least one tong component is formed by a tool which produces an injury of the printed sheet in the fold area thereof, for example, a plurality of needles or teeth which are capable of punching into the printed sheets and produce the deformation or injury in the quarto sheets when they are being grasped.

The deformation or injury could also be produced by perforating the quarto sheets placed next to each other or by punching portions out of the quarto sheets or by caulking the quarto sheets.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 8 is a perspective top view of another embodiment of a printed sheet;

FIG. 9 is a sectional view of a portion of the printed sheet back; and

FIG. 10 is a sectional view taken along sectional line A—A of FIG. 9.

DESCRIPTION OF THE PREFERRED EMBODIMENTS

Figure 1:
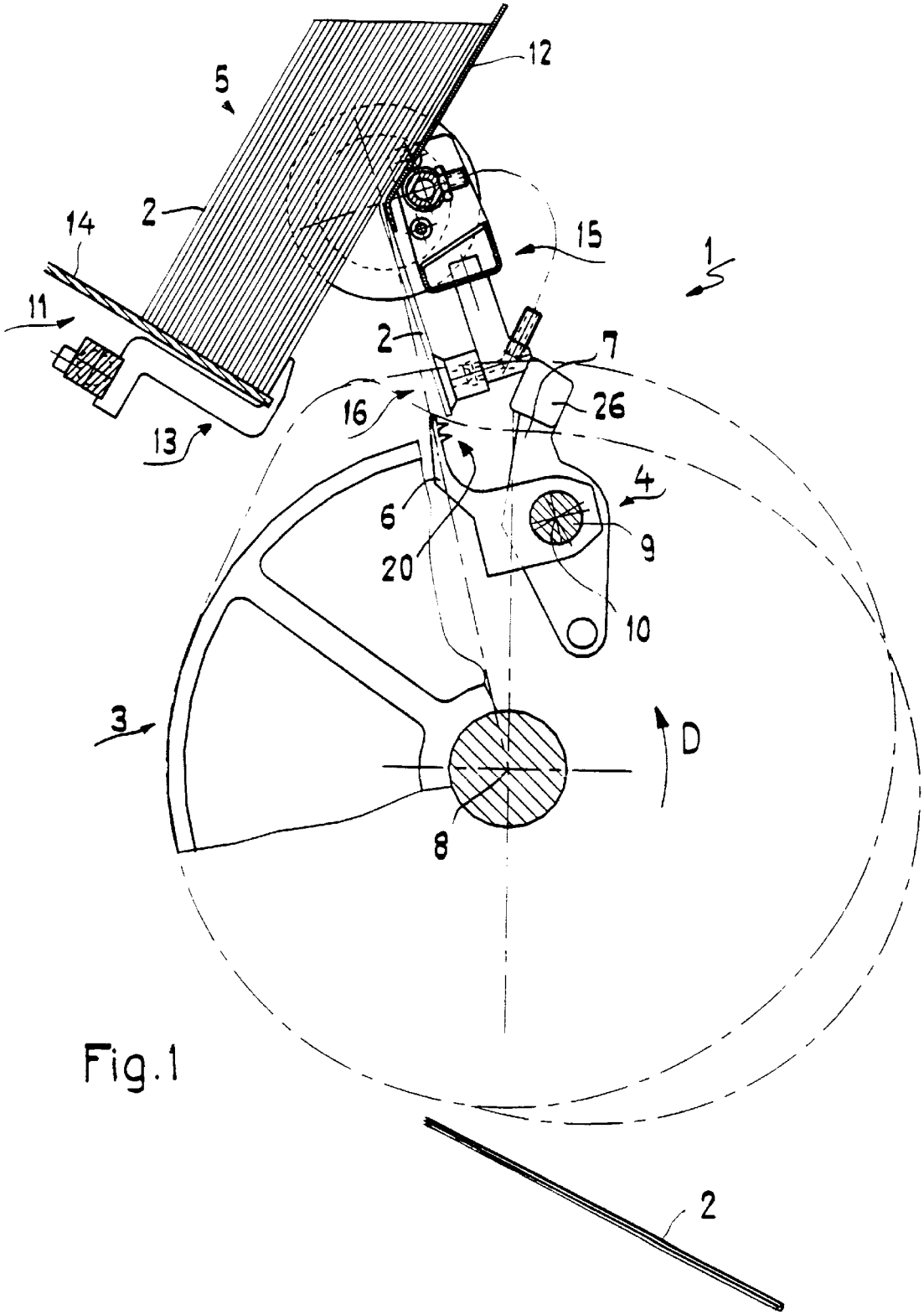
FIG. 1 is a side view of a printed sheet feeder.

FIG. 1 is an illustration of a printed sheet feeder 1 for supplying a conveying path of a conveying device, not shown, with folded and unfolded printed sheets 2, particularly those formed of a plurality of quarto sheets inserted into one another. The printed sheet feeder 1 shown in the drawing has a conveying rotor 3 with one or more gripping means 4 arranged at the circumference of the rotor 3, wherein usually two of the gripping means 4 are arranged over the width of the conveying rotor 3 which has an axis of rotation 8. The gripping means 4 are formed by tong components 6, 7 which act together to form tongs, wherein the tong component 7 trails in the direction of rotation D. In the illustrated embodiment, the tong components are mounted on a shaft 9 so as to be pivotable about the axis 10 of the shaft 9. The tong components can be moved between an open and a closed position by control means, not shown.

As illustrated in FIG. 1, the gripping means 4 is in the process of picking up a printed sheet 2 which has been partially lifted off from a stack 5, i.e., the printed sheet is being pulled from a magazine 11 arranged approximately above the conveying rotor 3. The printed sheets 2 composed of a plurality of quarto sheets inserted into one another are arranged in a stack in the magazine 11 and rest against a magazine floor 12. A retaining pawl 13, which is controlled in accordance with the pulling movement of the gripping means 4, holds back the printed sheet stack on the cut side so as to be in alignment with the magazine floor 12, wherein the printed sheets 2 rest with the folds on a downwardly inclined side wall 14 of the magazine 11.

Arranged underneath the magazine 12 is a separating device 15 which interacts with the retaining pawls 13 in accordance with the cycle of the conveying drum 3 or the gripping means 4 and which partially lifts the bottommost printed sheet 2 from the printed sheet stack 5 when the retaining pawl 13 is pulled back. As illustrated in FIG. 1, the printed sheet has already been grasped by a pivotable suction device 16 and the retaining pawl 13 has returned into its position of operation. The illustrated gripping means 4 is in the process of grasping near the fold the printed sheet 2 which has been partially lifted from the stack 5 by the suction device 16, wherein the free end of the printed sheet 2 still held in the magazine 11 has reached a position in which it is located unimpededly between the tong components 6, 7 which are travelling toward the transition point. At the transition point, the tong components 6, 7 close and pull as they continue to move the printed sheet 2 out of the magazine 11, i.e., between the magazine floor 12 and the remaining printed sheet stack 5.

After the conveying rotor 3 has rotated by approximately 180° since a printed sheet 2 has been picked up, the tong components 6, 7 open the gripping means 4 and the printed sheet 2, driven by the conveying rotor 3, moves approximately perpendicularly to the conveying direction at the conveying path of the conveying device, wherein engagement means grasp the printed sheet from the conveying device, the printed sheet is collected to form book blocks and is further transported. These steps are described in DE-C-31 26 769.

The change of direction of the printed sheets 2 when entering the conveying path cause the drive members to impart an acceleration force on the quarto sheets in the printed sheets 2 which may cause a displacement of the quarto sheets relative to the fold.

In order to prevent the quarto sheets from shifting relative to each other, the gripping means 4 are constructed with a tool 20 which injures the printed sheets 2 in the fold areas thereof by penetrating through the quarto sheets. In the embodiment illustrated in FIG. 1, the tool 20 is comprised of pointy teeth which punch into the printed sheet 2 when the gripping means 4 is closed and which secure the quarto sheets relative to each other by forming a ridge and a mutual intertwining of the paper fibers.

Of course, it would also be possible to use a tool 20 having blunt deforming means which connect the quarto sheets to each other by deforming them.

Figure 2:
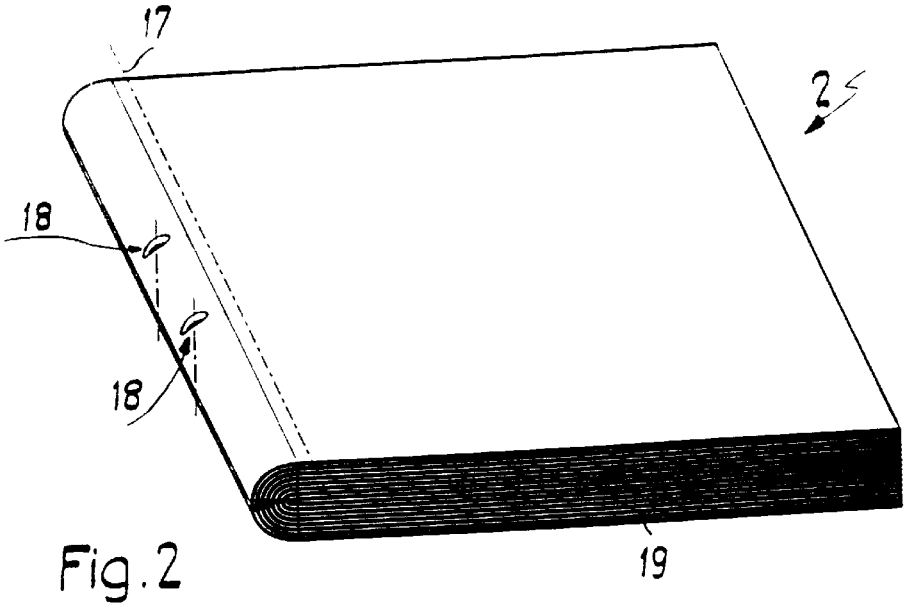
FIG. 2 is a perspective top view of a printed sheet.

FIG. 2 shows a printed sheet 2 formed of a plurality of quarto sheets 19 which are inserted into one another fold against fold, also called tabloid, which has open edges at three sides. In the fold area of the printed sheet 2, FIG. 2 shows two punched holes 18 which extend in an approximately perpendicular direction relative to the flat side of the printed sheet 2 and extend through the printed sheet fold 18 formed by the fold of the quarto sheets 19.

Figure 3:
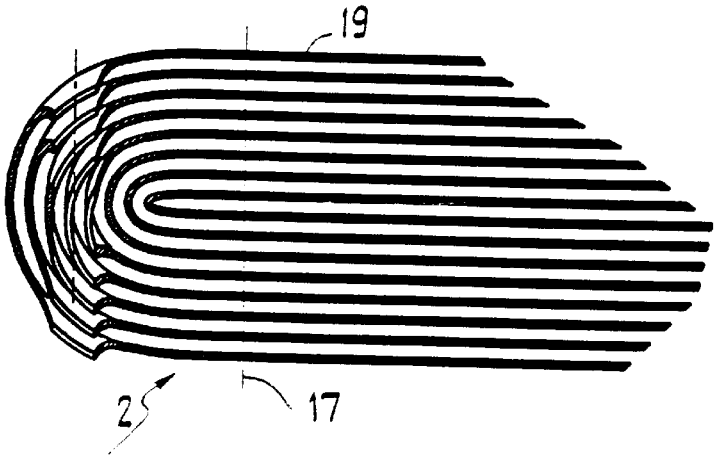
FIG. 3 is a longitudinal sectional view of a portion of the printed sheet of FIG. 2.

The cross-section of a punched hole 18 is illustrated in FIG. 3. In addition to the formation of a ridge at the punched hole 18 between the individual quarto sheets 19, it can be seen that the punched hole 19 is in the inclined fold portion and does not extend directly through the three innermost quarto sheets 19. The punching operation by means of the tool 20 also causes the quarto sheets 19 to be pressed together, so that an increased friction is produced between the inner quarto sheets 19 which has the tendency to prevent a displacement effect between the quarto sheets. This situation can be utilized in an advantageous manner, for example, in a narrow fold cut prior to gluing a book block back. The cut of the printed sheet 2 is indicated by a dash-dot line 17 in FIGS. 2 and 3.

Figure 4:
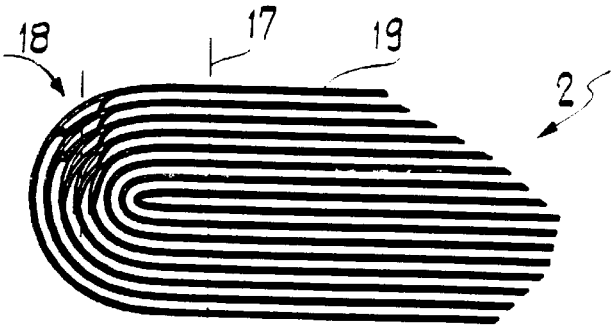
FIG. 4 is a longitudinal sectional view of another embodiment of the printed sheet of FIG. 2.

FIG. 4 shows a punched hole 21 produced by the tool 20 in the inclined fold portion of a printed sheet 2.

Figure 5:
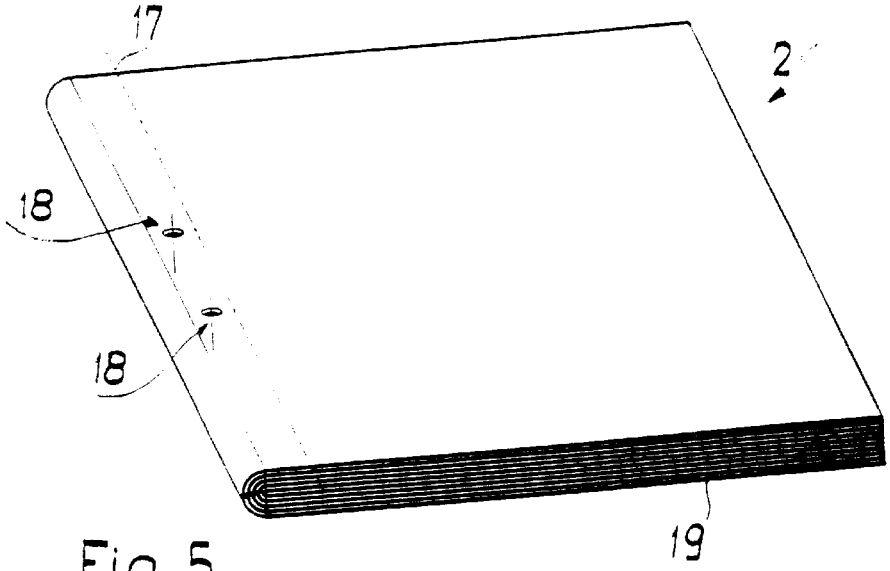
FIG. 5 is a perspective view of another embodiment of a printed sheet.
Figure 6:
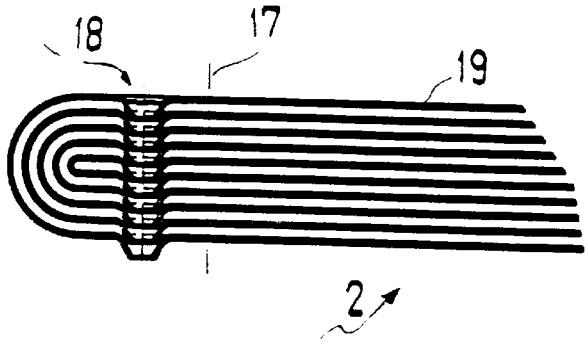
FIG. 6 is a longitudinal sectional view of a portion of the printed sheet of FIG. 5.
Figure 7:
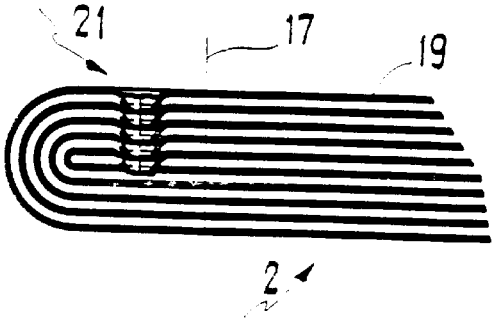
FIG. 7 is a longitudinal sectional view of another embodiment of the printed sheet of FIG. 5.

FIGS. 5 to 7 show a wider fold cut 17 than is the case in FIGS. 2 to 4, wherein the punched holes 18 or the partially punched holes 21 are provided in the parallel portion of a printed sheet 2 composed of quarto sheets 19.

The partial punched hole 21 in accordance with FIG. 7 into the middle of the printed sheet 2 causes the quarto sheets 19 in a printed sheet half to be essentially secured relative to each other.

The printed sheet 2 in FIG. 8 has been treated by a punching tool 20 which cuts approximately triangular portions out of the fold of the printed sheet 8 at various locations thereof.

These or similar cut portions 22 essentially have the same structure as the punched holes 18 or the partially punched holes 21. The protruding ridges formed at the edges cause the paper fibers to be intertwined, i.e., the quarto sheets 19 are hooked into each other and the quarto sheets 19 are locked against movement relative to each other.

FIG. 9 shows deformation of the cut portion 22 in an approximately vertical top view which shows the trough-like recess caused by the punching movement carried out from above.

FIG. 10 shows the cut portion 22 which extends through all quarto sheets 19 of the printed sheet 2 and which ends within the fold strip to be cut off.

The invention is not limited by the embodiments described above which are presented as examples only but can be modified in various ways within the scope of protection defined by the appended patent claims.

We claim:

1. A method of manufacturing book blocks of various printed sheets composed of a plurality of quarto sheets inserted into one another, the method comprising successively pulling fold first the printed sheets along a conveying path from a printed sheet stack by gripping means of a feeder and subsequently gathering the printed sheets with flat sides thereof resting against each other into book blocks, further comprising producing a deformation or injury at least partially extending through the quarto sheets by the gripping means which grasp the printed sheets approximately at the fold thereof.

2. The method according to claim 1, comprising producing the deformation or injury of the printed sheets in a fold strip to be cut off prior to binding.

3. The method according to claim 1, comprising producing the deformation or injury by a deforming tool, a punching tool or a perforating tool.

4. The method according to claim 1, comprising producing the deformation or injury at least in side portions of the quarto sheets forming a side of a printed sheet.

5. The method according to claim 2, comprising producing the deformation or injury of the printed sheet in an inclined fold portion thereof.

6. An apparatus for manufacturing book blocks from various printed sheets having a plurality of quarto sheets inserted into one another, the apparatus comprising printed sheet feeders arranged along a conveying path for gathering printed sheets into book blocks, the printed sheet feeders comprising controlled gripping means for grasping the printed sheets, wherein the gripping means comprise a tool for deforming or injuring the printed sheets in a fold area thereof.

7. The apparatus according to claim 6, wherein each gripping means is comprised of two tong components, and wherein at least one tong component is provided with the tool.

8. The apparatus according to claim 7, wherein the tool is a perforating tool, a punching tool or a caulking tool.

* * * * *